United States Patent [19]

Haas, Sr. et al.

[11] 4,274,535

[45] Jun. 23, 1981

[54] WAFER SHEET COOLER

[76] Inventors: Franz Haas, Sr., Gerstlgasse 25, Wien, Austria, 1210; Franz Haas, Jr., Castellezgasse 32, Wien, Austria, 1020; Johann Haas, Wiener Strasse 209-215, Spillern (Nö), Austria, 2104

[21] Appl. No.: 946,945

[22] Filed: Sep. 29, 1978

[30] Foreign Application Priority Data

Oct. 6, 1977 [AT] Austria ..... 7126/77

[51] Int. Cl.[3] ..... B65G 17/12; B65G 47/22

[52] U.S. Cl. ..... 198/493; 198/652; 198/654; 198/801; 198/952

[58] Field of Search ..... 198/493, 649, 654, 652, 198/653, 793, 796, 801, 952, 860, 861; 34/150, 236; 432/124, 239; 134/70, 71, 72, 73, 105, 124; 165/120; 271/195, DIG. 10

[56] References Cited

U.S. PATENT DOCUMENTS

| | | | |
|---|---|---|---|
| 226,735 | 4/1880 | Fernow | 198/652 |
| 3,596,752 | 8/1971 | Garvey | 198/860 X |
| 3,605,992 | 9/1971 | Weber | 271/DIG. 10 |
| 3,847,272 | 11/1974 | Anikanov et al. | 198/801 X |

FOREIGN PATENT DOCUMENTS

| | | | |
|---|---|---|---|
| 1264325 | 3/1968 | Fed. Rep. of Germany | 198/728 |
| 2248220 | 4/1974 | Fed. Rep. of Germany | 134/73 |
| 2306547 | 8/1974 | Fed. Rep. of Germany | 134/73 |

*Primary Examiner*—James L. Rowland

*Attorney, Agent, or Firm*—Schwartz, Jeffery, Schwaab, Mack, Blumenthal & Koch

[57] ABSTRACT

A wafer sheet cooler has a frame in the form of an archway in which two driven conveyor chains are guided parallel to the frame. The frame is preferably adapted to be assembled in accordance with a unit construction system. The archway frame has two upwardly converging vertical parts which enclose between them an angle ($\alpha$) of between 15° and 60°, preferably 30°, and merge into one another by means of a circular arcuate frame part.

17 Claims, 3 Drawing Figures

WAFER SHEET COOLER

Figure 1:
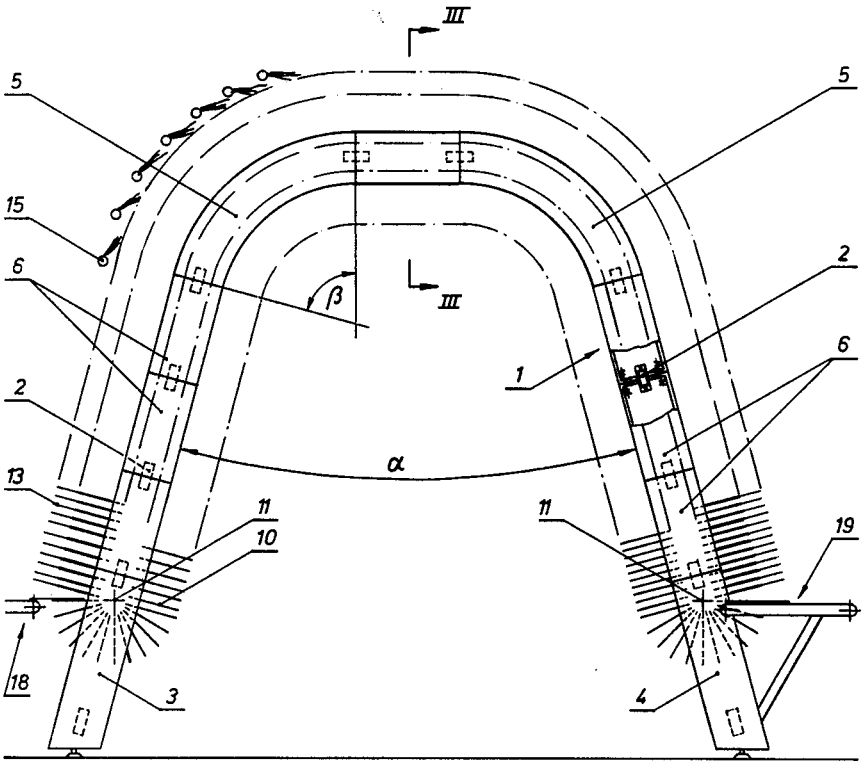

The invention relates to a wafer sheet cooler in whose frame are mounted two driven conveyor chains which are adapted to be advanced in timed sequence and which carry a multiplicity of compartments.

The most diverse constructions of wafer sheet coolers of this kind are known and serve the purpose of receiving the hot wafer sheets coming from the wafer baking oven and collecting them before they are passed on for further processing. During their stay in the wafer sheet cooler the wafer sheets should also be cooled and relieved of stress, that is to say relieved of the stresses produced in the wafer sheet during the baking process. Since this process requires a certain time, it is necessary for the number of compartments which have to be filled in the wafer sheet cooler to be adapted to the production capacity of the wafer baking oven. Until recently the output of the largest wafer baking oven amounted to about 24 wafer sheets per minute, although this output could be achieved only in the rarest cases because the other machines in a production line for the production of filled wafers were not able to handle such high outputs without excessive reject rates. In the course of the development of the last few years wafer baking ovens and filling machines having an output of up to 50 wafer sheets per minute have been developed. With outputs of this kind the conventional wafer sheet coolers become too long, so that the place required for a complete production plant, which had already considerably increased by the high-output wafer baking ovens, is increased still further.

In production lines in which lengths of 100 meters are not rare, there is in addition another problem, namely the problem that it is practically impossible to pass from one side to the other without having to go round one end of the plant. This problem is very disturbing particularly when the line is of an undulating shape or when a plurality of lines are disposed side by side. The construction of neighbouring lines as left-hand and right-hand line respectively also does not produce an actual improvement, since for reasons of manufacture it is not possible for all operating controls to be disposed on the left-hand or right-hand side. When any intervention is necessary in individual machines there is consequently a waste of valuable time because the operator must first walk around the line. An operator (quality controller) will, however, have to keep a number of installations under constant watch, so that absolutely easy and rapid access to the individual machines of the lines must be ensured. For this purpose footbridges for crossing the lines have already been provided or parts of conveyor belts between individual machines were arranged to swing up. The foot-bridges take up considerable space and therefore usually cannot be used. Where conveyor belts adapted to swing up are concerned, on the other hand, there is an interruption of the continuous process because the transport of the wafer sheets or blocks is impossible while the operator is passing through.

The most sensitive parts of a production line are the wafer baking oven and the filling machine; breakdowns in the latter may be caused by the breaking-up of the wafer sheets. However, because of the running-down time of the baking oven the supply of wafer sheets to the filling machine cannot be suddenly stopped. Rapid intervention by the inspector or operator is therefore necessary. For this reason it is desirable for the operator to be able to pass easily from one side of the plant to the other in the region of the filling machine.

The problem underlying the invention is, therefore, that of providing a wafer sheet cooler which in respect of the number of its compartments can be adapted without difficulty to the output of the appertaining wafer baking oven, which is distinguished by requiring little space, and which in particular makes it possible to pass rapidly from one side to the other in the region of the filling machine.

According to the invention these problems are solved in that the frame is in the form of an archway and the conveyor chains are provided parallel to the frame, and that the frame is preferably adapted to be assembled in accordance with a unit construction system. The two upwardly converging vertical parts of the archway frame preferably enclose between them an angle of between 15° and 60°, preferably 30°, and merge into one another with the aid of a circular arcuate frame part.

Through the inclination of the vertical frame parts it is ensured that the wafer sheets remain lying securely in the compartments even when there is a current of air (draft).

The conveyor chains carrying the compartments are guided on slide rails substantially over their entire length and only at the reversal points of the compartments are they guided over respective pairs of chain wheels, of which one or both can be driven. The unit construction system according to the invention consists substantially of only seven parts, namely a right-hand and a left-hand inlet part, a right-hand and a left-hand outlet part, a straight frame part and a curved frame part, together with a cross-strut, while the angle of the circular arc of the curved frame part corresponds to an angle resulting from the deduction from the angle of 90° of half the angle enclosed between the vertical frame parts.

Particularly as the result of this unit construction system the number of compartments can be adapted in a simple manner to the output of the automatic wafer baking oven by inserting a number of straight frame parts. In addition, the shape of the wafer sheet cooler can be modified in the most diverse manner, for example the wafer sheet cooler can be given a passage width and height permitting the passage of a high-lift truck by inserting a number of straight frame parts between the two curved frame parts.

It is also thus possible to bridge over considerable differences in level between the wafer baking oven and the filling machine, for example when the former is on the ground floor and the latter on the first floor, without special manufacture of the frame being necessary.

Finally, since the frame parts are aluminium castings and have undergone surface treatment, for example anodization, no cladding is required, or the cladding takes over the function of the frame.

Figure 2:
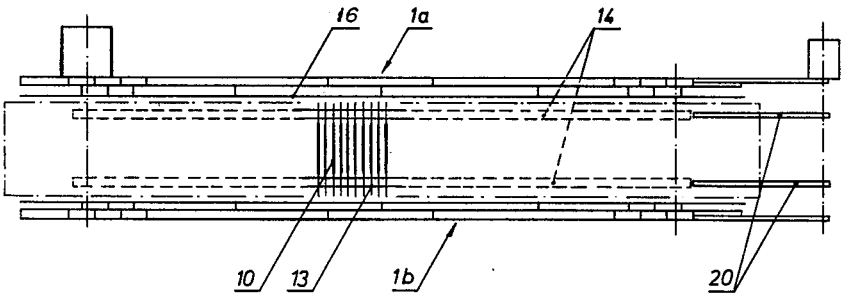

Further details of the wafer sheet cooler according to the invention and of its advantages are explained more fully below with reference to an example of construction of a wafer sheet cooler of this kind, which is illustrated in the drawings, in which:

FIG. 1 is a side view of a wafer sheet cooler according to the invention,

FIG. 2 a plan view of the wafer sheet cooler shown in FIG. 1, and

Figure 3:
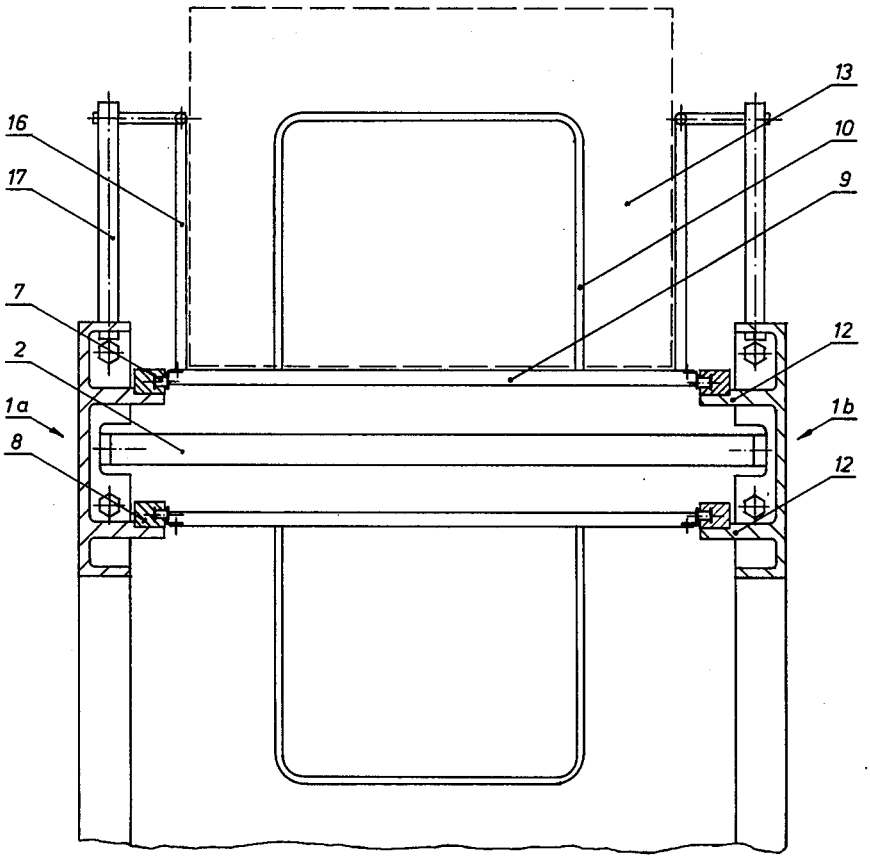

FIG. 3 is a section on the line III—III in FIG. 1, on a larger scale.

The frame 1 of the wafer sheet cooler according to the invention, which is in the form of an archway, consists of a left-hand frame 1*a* and a right-hand frame half 1*b*. The two frame halves 1*a* and 1*b* are joined together solely by cross-struts 2. In each of the frame halves 1*a*, 1*b* a conveyor chain 7 is provided, on which are fastened the compartments formed by the wire bows 10, together with the compartment carriers 9. The conveyor chains 7 are guided substantially over their entire length in or on slide rails 8 and only at the reversal points of the compartments are guided by means of respective pairs of chain wheels 11, of which one or both may be driven. Each frame half 1*a*, 1*b* consists of a plurality of frame parts 3,4,5,6, which together with the cross-struts form a seven-part unit construction frame system. Each of the frame parts 3,4,5,6 is made of cast aluminium and has a substantially U-shaped cross-section, the web of the U-shaped cross-section serving at the same time as covering for the conveyor chains 7. The frame thus forms a self-supporting covering. The wall parts formed by the legs of the U-shaped cross-section are also provided on the shorter sides of the frame parts 3,4,5,6, while the individual frame parts 3,4,5,6 are joined together by the shorter sides with the aid of screws or the like. The cross-struts 2 lie with their longitudinal axes exactly on the joint between the individual frame parts 3–6. The slide rails 8 for the conveyor chains 7 are fastened on ribs 12 projecting perpendicularly from the web of the U-shaped cross-section of the frame parts 3–6 and extending beyond the legs of the latter.

The two upwardly converging vertical parts of the archway frame enclose between them an angle $\alpha$ of between 15° and 60°, preferably 30°, and merge into one another by a circular arcuate frame part 5.

The angle $\beta$ of the curved frame part 5 is formed by deducting half the angle $\alpha$ from an angle of 90°. Owing to the fact that the vertical parts of the archway frame are divided at least into part 3 or outlet part 4 and a straight frame part 6, any desired height or the archway can be achieved by using a corresponding number of straight frame parts 6.

Since owing to the deflection of the conveyor chain 7 once in the upward and once in the downward direction a slot is formed between the compartment carriers 9 carrying the wire bows 10 of the compartments, and textile bands 14 forming the bottoms of the compartments are stretched over the compartment carriers 9 at the side of the wire bows 10 in order to prevent the wafer sheets 13 from falling through between the compartment carriers 9. The textile bands 14 are disposed so as to be immovable in the direction of movement of the compartments, that is to say the ends of the textile bands 14 are fastened on the inlet part 3 and outlet part 4. It is however also possible for the textile bands 14 to move together with the compartment carriers 9, in which case the textile bands 14 are fastened at long intervals, for example only at every twentieth compartment carrier.

It will be apparent from the drawing that each wire bow 10 has a pair of side portions, joining the associated compartment carrier 9 in certain regions and extending outwardly from the associated compartment carrier, and a cross portion extending between the two side portions. It will also be apparent from the drawing that the textile bands extend over the compartments in the regions of the compartment carriers 9 where the side portions of the wire bows 10 join the compartment carriers.

When they pass the curved transition between the vertical parts of the archway the wafer sheets 13 contained in the compartments must be transferred from the wire bow 10 situated downstream of the wafer sheet 13 in the direction of transport onto the wire bow situated upstream of the wafer sheet in the same direction. In order now to prevent the sensitive wafer sheets 13 from breaking-up during this transfer operation, this operation is not left to chance but is carried out in a planned manner. For this purpose there is disposed in the region of the deflection of the filled compartments, at the beginning of a circular arcuate frame part 5, an auxiliary device 15 which lifts the wafer sheet 13 contained in the compartment off the wire bow 10 lying downstream of the wafer sheet 13 in the direction of transport of the compartments, and gently transfers it, avoiding an impact, onto the wire bow 10 disposed upstream of the wafer sheet 13. This auxiliary device 15 may be in the form of one or more blast nozzles disposed one behind the other in the direction of transport.

In order to prevent the wafer sheets 13 from falling out at the sides from the compartments formed by the wire bows 10, guides 16 are disposed laterally at the side of the wire bows. These guides each consist of a round bar which is disposed parallel to and at a distance from the archway frame and which is fastened on rods 17 fastened laterally on the frame 1*a*, 1*b*.

The wafer sheets coming from the delivery belt of the wafer sheet take-off device of a wafer baking oven are introduced at 18 into the compartments of the wafer sheet cooler. The conveyor chains of the wafer sheet cooler can either be driven by constraint by the wafer sheet cooler or by its own drive motor. In the latter case a light barrier must be provided, which is interrupted by the wafer sheet running into the compartment and with the aid of a time lag relay switches on the drive motor, which advances by one step the compartment which has just been filled, so that an empty compartment is then ready again to receive a wafer sheet.

The wafer sheets are taken from the compartments at 19 by two round belts 20, on which the wafer sheet is laid when the wire bow 10 passes between the round belts 20, which then pull the wafer sheet out of the compartment.

To restate, in different terms, what has been disclosed above and what is disclosed in the drawing, the cooling device of the present invention includes a frame, which frame has the configuration of an arch with a pair of spaced, upstanding portions 3, 4, 6, a bridge portion 5 extending between the upstanding portions, an entry side 3 at one upstanding portion 3 for receiving wafers to be cooled, and a discharge side 4, at the other upstanding portion for discharging cooled wafers. The arched configuration of the frame defines a passageway therethrough which is of such size and shape as to at least permit a human attendant to readily pass therethrough. The frame has an inwardly facing side which faces toward the passageway and an outwardly facing side which faces away therefrom. The device of the invention also includes means coupled with the frame for advancing wafers only along the upwardly facing side of the frame and for turning the wafers from a first generally reclined position at the entry side to an upright position downstream of the entry side and thence to a second, generally reclined position at the discharge side of the frame. Each wafer is inverted from its first horizontal position when in the second horizontal position. The foregoing advancing and turning means includes the aforementioned arched configuration of the frame 1, a driven member 7 which travels along the frame 1 and a plurality of movable compartments coupled with the driven member.

The driven member travels along the frame adjacent the outwardly facing side in certain directions of travel corresponding to the directions in which the frame extends. The driven member and movable compartments travel along the inwardly facing side of the frame in other directions of travel which are generally opposite to corresponding ones of the certain directions of travel along the outwardly facing side. The compartments each include a carrier 9 located substantially in a plane parallel to the direction of travel at each point along the frame 1 and a pair of supports extending outwardly from the carrier. Each pair of supports includes a downstream support and an upstream support, each wafer being supported by the downstream support when in the first reclined position and by the upstream support when in the second reclined position. The supports are adapted to hold the wafers only when traveling in the certain directions of travel adjacent the outwardly facing side of the frame. It will be seen that the arched configuration of the frame contributes both to the turning of the wafers and to the provision of a passageway through the frame.

Each support, preferably takes the form of the foregoing wire bows 10. The compartments are arranged in succession along the driven member, and the upstream support or wire bow 10 of one compartment serves as the downstream support for the next succeeding compartment.

What is claimed is:

1. In a wafer sheet cooler in the frame of which two driven conveyor chains are mounted, which are adapted to be advanced in timed sequence and which carry a multiplicity of compartments, the improvement comprising: a frame; means for allowing a human attendant to readily pass through said frame, said allowing means including an arched configuration of said frame, said arched configuration defining a passageway through said frame the conveyor chains being guided parallel to the frame; two sets of chain wheels coupled with the conveyor chains, at least one of the sets of chain wheels being driven, the conveyor chains having reversal points at which their directions of travel are reversed, the reversal points being provided by the sets of chain wheels; a plurality of slide rails coupled with the frame, the conveyor chains carrying the compartments being guided on the frame over substantially the entire length of the chains by the slide rails and otherwise being guided at the reversal points by the sets of guide wheels.

2. A wafer sheet cooler according to claim 1, wherein the two upwardly converging vertical parts of the archway frame enclosed between them an angle of between 15° and 60°, preferably 30°, and merge into one another by means of a circular arcuate frame part.

3. A wafer sheet cooler according to claim 1 wherein the frame consists substantially of only seven parts, namely a right-hand and a left-hand inlet part, a right-hand and a left-hand outlet part, a straight and a curved frame part, and also a cross-strut.

4. A wafer sheet cooler according to claim 3, wherein the angle of the circular arc of the curved frame part corresponds to the angle resulting from the deduction from an angle of 90° of half the angle enclosed between the vertical frame parts.

5. A wafer sheet cooler according to claim 4, wherein the frame parts are aluminium castings and have a substantially U-shaped cross-section, the web serving at the same time as covering for the conveyor chains.

6. A wafer sheet cooler according to claim 5, wherein the frame parts are elongated so as to have relatively long sides in the lengthwise direction and relatively shorter sides extending generally transversely of the longer sides; wherein the wall parts formed by the legs of the U-shaped cross-section are also provided on the shorter sides of the frame parts, while the individual frame parts are joined together by the shorter sides with the aid of screws or the like.

7. A wafer sheet cooler according to claim 6, wherein the slide rails for the conveyor chains are fastened on ribs which project perpendicularly from the web of the U-shaped cross-section of the frame parts and extend beyond the legs of the latter.

8. A wafer sheet cooler according to claim 7, wherein the cross-struts which alone join together the two frame halves lie with their longitudinal axis exactly on the joint between the individual frame parts.

9. A wafer sheet cooler according to claim 8, in which the compartments are formed by wire bows which are fastened on compartment carriers carried by the two conveyor chains, each wire bow having a pair of spaced side portions joining the carrier in certain regions and extending outwardly from its associated carrier and a cross portion spaced from the associated carrier and extending between the two side portions, wherein textile bands which form the bottoms of the compartments are stretched over the compartment carriers so as to extend over said compartment carriers in the regions of the compartment carriers where the side portions of the bows join the compartment carriers.

10. A wafer sheet cooler according to claim 9, wherein the textile bands are disposed so as to be immovable in the direction of transport of the compartments.

11. A wafer sheet cooler according to claim 9, wherein the textile bands move with the compartment carriers.

12. A wafer sheet cooler according to claim 11, wherein the textile bands are fastened at long intervals, for example on every twentieth compartment carrier.

13. A wafer sheet carrier according to claim 12, wherein in the region of the beginning of the curved frame part, in which the filled compartments are deflected, an auxiliary device is provided which lifts off the wafer sheet situated in the compartment from the wire bow disposed downstream of the wafer sheet in the direction of transport of the compartments and transfers it to the wire bow disposed upstream of the wafer sheet.

14. A wafer sheet cooler according to claim 13, wherein the auxiliary device is formed by a blast nozzle.

15. A wafer sheet cooler according to claim 14 wherein a plurality of auxiliary devices are disposed one behind the other in the direction of transport.

16. A device as defined in claim 15 wherein each support takes the form of a wire bow and wherein said compartments are arranged in succession along said driven member, the upstream support of one compartment serving as the downstream support for the next succeeding compartment.

17. A device for cooling and conveying wafer sheets comprising:

(a) a frame, said frame having the configuration of an arch with a pair of spaced, upstanding portions, a bridge portion extending between said upstanding portions, an entry side at one upstanding portion for receiving wafers to be cooled and a discharge side at the other upstanding portion for discharging cooled wafers; said arched configuration of said frame defining a passageway therethrough which is of such size and shape as to at least permit a human attendant to readily pass therethrough; said frame having an inwardly facing side which faces toward said passageway and an outwardly facing side which faces away therefrom;

(b) means, coupled with said frame, for advancing wafers only along said upwardly facing side of said frame and for turning the wafers from a first generally reclined position at said entry side to an upright position downstream of said entry side and thence to a second, generally reclined position at said discharge side, the wafer being inverted from its first horizontal position when in the second horizontal position, said advancing and turning means comprising:

(i) said arched configuration of said frame;

(ii) a driven member which travels along said frame adjacent said outwardly facing side in certain directions of travel corresponding to the directions in which the frame extends and along the inwardly facing side of said frame in other directions of travel which are generally opposite to corresponding ones of the certain directions of travel;

(iii) a plurality of movable compartments coupled with said driven member to be driven thereby in the same directions of travel as those of said driven member, said compartments each including a carrier located substantially in a plane parallel to the direction of travel at each point along the frame and a pair of supports extending outwardly from said carriers, each pair of supports including a downstream support and an upstream support, each wafer being supported by said downstream support when in the first reclined position and by the upstream support when in the second reclined position; said supports being adapted to hold the wafers only when traveling in said certain directions of travel adjacent said outwardly facing side of said frame; and (c) whereby said arched configuration of said frame contributes both to the turning of the wafers and to the provision of a passageway through the frame.

* * * * *